US005154133A

United States Patent [19]

Hallerberg

[11] Patent Number: 5,154,133

[45] Date of Patent: Oct. 13, 1992

[54] TWIN-FLUKE MARINE ANCHOR HAVING AN ADJUSTABLE SHANK/FLUKE PIVOT ANGLE

[76] Inventor: Don M. Hallerberg, 20 Bay Colony Dr., Ft. Lauderdale, Fla. 33308

[21] Appl. No.: 663,598

[22] Filed: Mar. 1, 1991

[51] Int. Cl.[5] ..... B63B 21/24

[52] U.S. Cl. ..... 114/303

[58] Field of Search ..... 114/294, 295, 297, 301, 114/302, 303, 304, 305, 306, 307, 308, 309, 310

[56] References Cited

U.S. PATENT DOCUMENTS

| | | | |
|---|---|---|---|
| 135,450 | 2/1873 | Smith . | |
| 270,168 | 1/1883 | Willis . | |
| 327,767 | 10/1885 | Coles . | |
| 527,060 | 10/1894 | House et al. . | |
| 536,177 | 3/1895 | Baker . | |
| 575,082 | 1/1897 | Tyzack . | |
| 652,162 | 6/1900 | Blackburn . | |
| 670,368 | 3/1901 | Byers . | |
| 1,258,119 | 3/1918 | Johannessen . | |
| 1,372,259 | 3/1921 | Wenlock et al. . | |
| 1,373,741 | 4/1921 | Jones . | |
| 1,782,449 | 11/1930 | Siebert . | |
| 1,865,163 | 6/1932 | Bedell . | |
| 1,978,844 | 10/1934 | McLeland . | |
| 2,208,663 | 7/1940 | Conroy . | |
| 2,249,546 | 7/1941 | Danforth . | |
| 2,282,566 | 5/1942 | Danforth . | |
| 2,320,966 | 6/1943 | Danforth . | |
| 2,354,666 | 8/1944 | Danforth . | |
| 2,368,942 | 2/1945 | Northrop . | |
| 2,451,719 | 10/1948 | Danforth . | |
| 2,465,261 | 3/1949 | Pabst . | |
| 2,507,563 | 5/1950 | Farren . | |
| 2,576,172 | 11/1951 | Burleson, Sr. . | |
| 2,576,390 | 11/1951 | Danforth . | |
| 2,633,626 | 4/1953 | Danforth . | |
| 2,641,215 | 6/1953 | Danforth . | |
| 2,643,631 | 6/1953 | Danforth . | |
| 2,656,811 | 10/1953 | McRae . | |
| 2,687,106 | 8/1954 | Linnenbank et al. . | |
| 2,705,467 | 4/1955 | Ogg et al. . | |
| 2,722,191 | 11/1955 | Johnson . | |
| 2,797,657 | 7/1957 | Smith . | |
| 2,840,029 | 6/1958 | Ogg . | |
| 2,990,799 | 7/1961 | Morgan et al. . | |
| 2,994,292 | 8/1961 | Winslow . | |
| 3,045,633 | 7/1962 | Sarns . | |
| 3,071,096 | 1/1963 | Meno . | |
| 3,120,830 | 2/1964 | Northrop et al. . | |
| 3,382,835 | 5/1968 | McGuire . | |
| 3,428,014 | 2/1969 | Smith et al. . | |
| 3,771,486 | 11/1973 | Hungerford . | |
| 3,780,688 | 12/1973 | Hungerford | 114/303 |
| 3,822,665 | 7/1974 | Hungerford . | |
| 3,822,666 | 7/1974 | Blomberg . | |
| 3,858,543 | 1/1975 | Hungerford . | |
| 3,964,420 | 6/1976 | Stelling . | |
| 4,058,078 | 11/1977 | Stelling . | |
| 4,385,584 | 5/1983 | Simpson, III . | |
| 4,892,053 | 1/1990 | Hallerberg | 114/303 |

FOREIGN PATENT DOCUMENTS

| | | | |
|---|---|---|---|
| 623775 | 9/1978 | U.S.S.R. | 114/303 |

*Primary Examiner*—Jesus C. Sotelo
*Assistant Examiner*—Stephen P. Avila
*Attorney, Agent, or Firm*—Knobbe, Martens Olson & Bear

[57] ABSTRACT

Described is a twin-fluke anchor, capable of disassembly, for mooring a marine vessel in waters having generally sandy or muddy underwater bottoms to prevent the vessel from drifting with the wind or tide. The anchor is capable of assembly in two different configurations to vary the shank/fluke angle to optimize the holding power of the anchor in accordance with the firmness of the underwater bottom surface.

11 Claims, 3 Drawing Sheets

TWIN-FLUKE MARINE ANCHOR HAVING AN ADJUSTABLE SHANK/FLUKE PIVOT ANGLE

BACKGROUND OF THE INVENTION

1. Field of the Invention

The invention relates to a marine anchor and, more specifically, to a twin-fluke, lightweight, high performance aluminum alloy anchor.

2. Description of Related Art

U.S. Pat. No. 4,892,053 twin-fluke anchor describes an improved aluminum anchor having a shank, a stock, and a pair of flukes coupled together by a crown structure and having the holding power of heavier steel anchors.

When a twin-fluke anchor rests on an underwater bottom, an anchor line or rode connects a boat or other marine vessel floating on the surface to an outer end of the anchor shank. The anchor rode pulls the anchor forward along the bottom as the marine vessel drifts with the wind or tide. The crown structure of the anchor, resting on one of its two crown plates, tends to resist the forward motion and elevates an aft end of the anchor thereby tipping the anchor to orient the anchor fluke tips downward towards the underwater bottom surface. As the anchor draws forward, the flukes bury themselves into the bottom surface. And with increase force on the rode, the flukes continue to bury themselves deeper into bottom to provide greater holding power. Typically, an anchor buries itself several feet under the bottom surface, particularly in muddy or sandy underwater bottoms.

The holding power of an anchor depends in part upon the underwater bottom surface condition. Most underwater bottoms consist of firm, good holding ground, such as sandy bottoms. But in calm bays and estuaries where silt and vegetable sediment accumulate, the bottoms consist of soft mud which provides poor holding ground for anchors.

The holding power of a twin-fluke anchor also depends upon the anchor's shank/fluke angle, i.e., the angle between the shank and the effective surface of the flukes. By increasing the shank fluke angle from a standard angle of approximately 30 to 35 degrees to an angle of approximately 40 to 55 degrees, the anchor substantially increases its holding power in poor holding ground, such as muddy bottoms.

In good holding ground, however, the standard shank/fluke angle of 30 to 35 degrees is necessary to set the anchor. If the angle is greater than about 35 degrees, for example if the shank/fluke angle is 45 degrees, the fluke tips drag along the firm underwater bottom and have difficulty initially digging into the surface to bury themselves. Further, when digging in at the increased angle, the planar portion of the flukes become caked with ground which substantially reduces the anchor's holding power.

SUMMARY OF THE INVENTION

The present invention defines a twin-fluke anchor for mooring a marine vessel in waters having generally sandy or muddy bottoms to prevent the vessel from drifting with the wind or tide. The anchor is capable of reassembly to adjust a shank/fluke angle to optimize the holding power of the anchor depending upon the firmness of the underwater bottom surface.

The anchor comprises a crown structure having a first and a second set of apertures and a stock removably coupled to the crown structure by insertion through one set of the crown structure apertures. A pair of flukes attach to the crown structure and a shank rotatably mounts to the crown structure by engaging with the stock. With the stock positioned in the first set of apertures, the shank forms a first angle with an effective surface of the flukes, i.e., forms a first shank/fluke angle. The anchor can be reassembled to position the stock through the second set of apertures and thus reposition the shank to form a second shank/fluke angle.

In a preferred embodiment, the second shank/fluke angle is larger than the first shank/fluke angle, and more preferably is about 15 degrees larger. It is also preferred that the first shank/fluke angle equals about 30 to 35 degrees and the second shank/fluke angle equals about 43 to 47 degrees. More preferably, the first shank/fluke angle equals 32 degrees and the second shank/fluke angle equals 45 degrees.

In accordance with another aspect of the invention, the invention defines a twin-fluke anchor for mooring a marine vessel to prevent the vessel from drifting with the wind or tide, comprising a crown structure, a pair of flukes attached to the crown structure, and a shank rotatably coupled with the crown structure. The shank is positioned to form a first shank/fluke angle between the shank and an effective surface of the flukes, and is adapted to be repositioned to form a second shank/fluke angle larger than the first angle. In the preferred embodiment, the first angle equals approximately 30–35 degrees, and more preferably equals 32 degrees, and the second angle equals approximately 43–47 degrees, and more preferably equals 45 degrees.

DESCRIPTION OF THE PREFERRED EMBODIMENT

Figure 1:
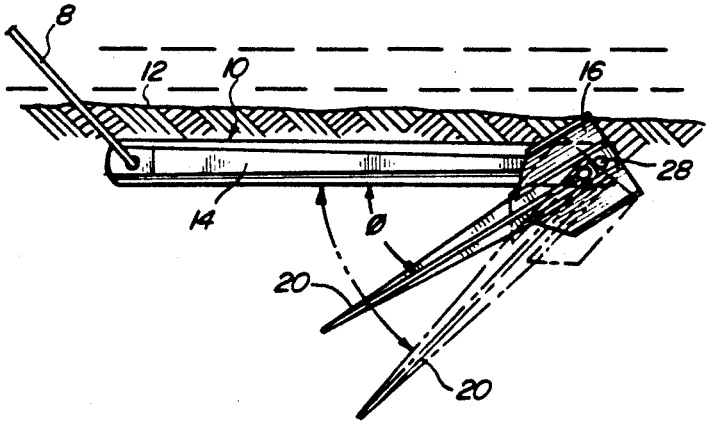
FIG. 1 is a side plan view of a twin-fluke anchor according to a preferred embodiment of the invention engaging an underwater surface, illustrating a standard and an optional anchor configuration.

FIG. 1 shows a preferred embodiment of the present anchor 10 engaged with the underwater surface 12, and illustrates a standard anchor configuration as well as an optional configuration (shown in phantom lines). It is preferred that the anchor is capable of adjusting between these two configuration in order to optimize the holding power to the anchor depending upon the bottom surface conditions, as explained below.

The anchor 10 principally comprises a crown structure 16, a shank 14, a pair of flukes 20 and a stock 28. These principal components are preferably constructed of extruded aluminum alloy, and more preferably of extruded 6061 T6 aluminum alloy.

When engaging with the underwater bottom surface 12, as shown in FIG. 1, the crown structure 16 usually completely embeds in the underwater surface 12, particularly when the anchor 10 engages sandy or muddy bottom surfaces. The shank 14 extends to its maximum angular position and rests roughly parallel with the underwater surface 12. The flukes 20 embed deeply in the underwater surface 12 to prevent the anchor 10 from readily moving. An anchor rode 8, attached to an outer end of the shank 14, connects the anchor 10 to a marine vessel (not shown) on the surface of a body of water.

Figure 4:
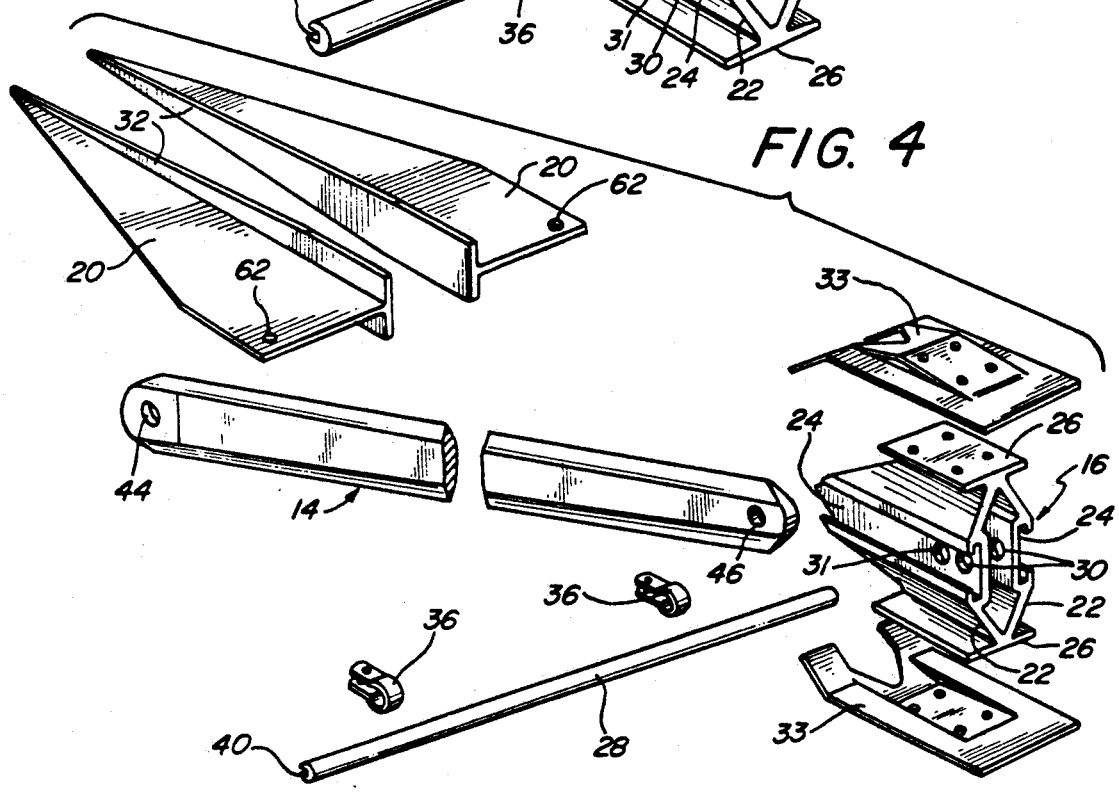
FIG. 4 is an exploded perspective view of the anchor of FIG. 2 and a pair of mud palms.

Referring to FIG. 4, the crown structure 16 comprises a pair of angled side walls 22 disposed between generally parallel crown plates 26. The merger of the side walls 22 into the crown plates 26 results in thick central portions that effectively reinforces the crown structure 16 in the juncture areas. Incorporated within the outwardly angled side walls 22 is a fluke retaining means. The fluke retaining means comprises a slot along the exterior length of the side walls, opening onto an inset flange receiving member 24. The inset member 24 partially fills the interior volume of the crown structure. Two sets of side wall apertures 30, 31 pierce through the inset flange receiving members 24. The size of the apertures 30, 31 permit the stock 28 to freely pass through the apertures.

Each fluke 20 has a generally triangular shape, including a rear edge, an inner edge and an outer edge merging with the inner edge to form a point. A flange 32 along the inner edge portion of each fluke 20 extends to the rear edge of the fluke 20 so that, when viewed along the rear edge, the fluke/flange union appears T-shaped. Each fluke 20 also includes a fluke aperture 62 located near the outer rear edge portion.

The stock 28 comprises an elongated rod-like member of sufficient length to extend beyond the outermost fluke 20 edges, and includes a longitudinal slot 40. When the stock 28 inserts through one set of the side wall apertures 30, 31, it is oriented to direct the slot 40 towards the front of the crown structure 16. The slot 40 receives a portion of the rear edge of the flukes 20 when assembled.

The shank 14 is an elongated member generally rectangular in plan view and having an octagonal cross section, preferably of uniform height along its length. The octagonal configuration increases the contact area between the shank 14 and the crown plates 26. An outer shank aperture 44 at a distal end of the shank 14 allows the connection of the anchor rode 8 to the anchor 10. An inner aperture 46 at a proximate end of the shank 14 allows the stock 28 to pass through the shank 14 and allows the rotation of the shank about the stock 28.

Figure 2:
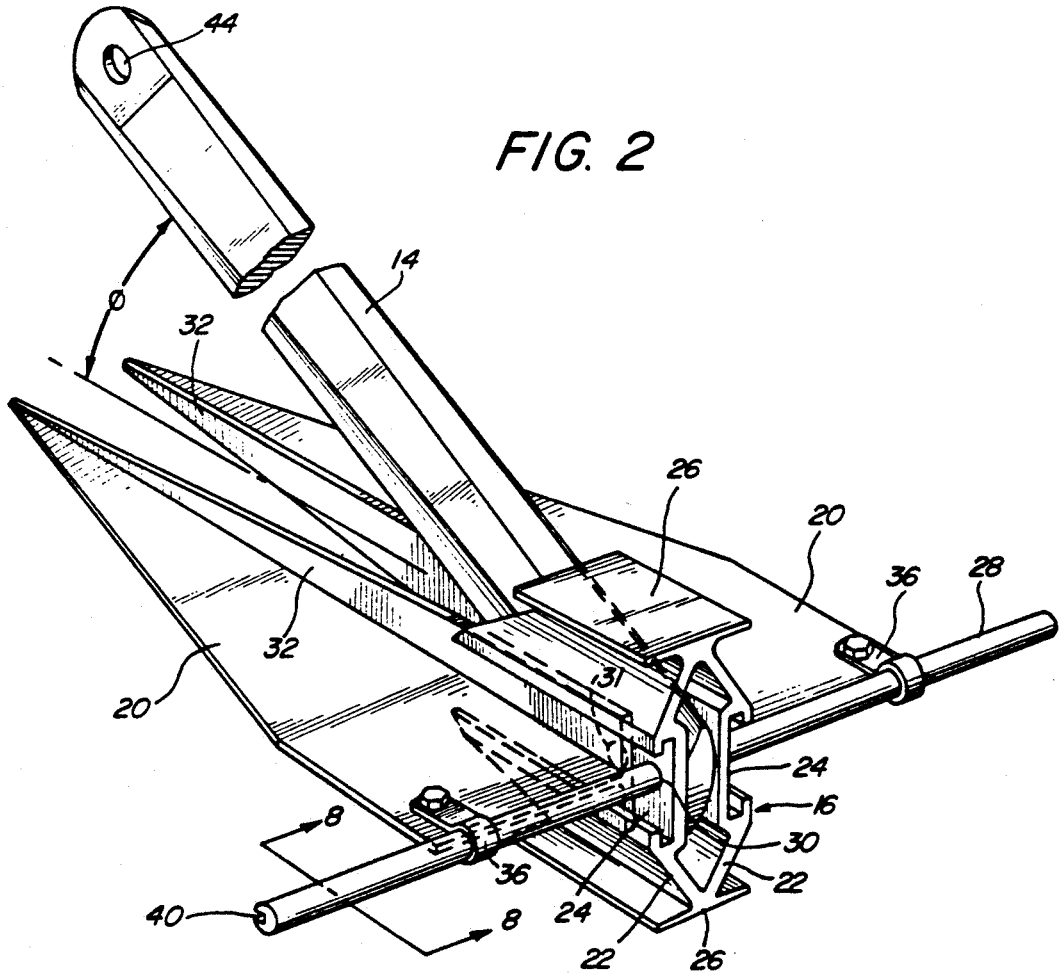
FIG. 2 is a perspective view of the standard configuration of the anchor of FIG. 1.
Figure 6:
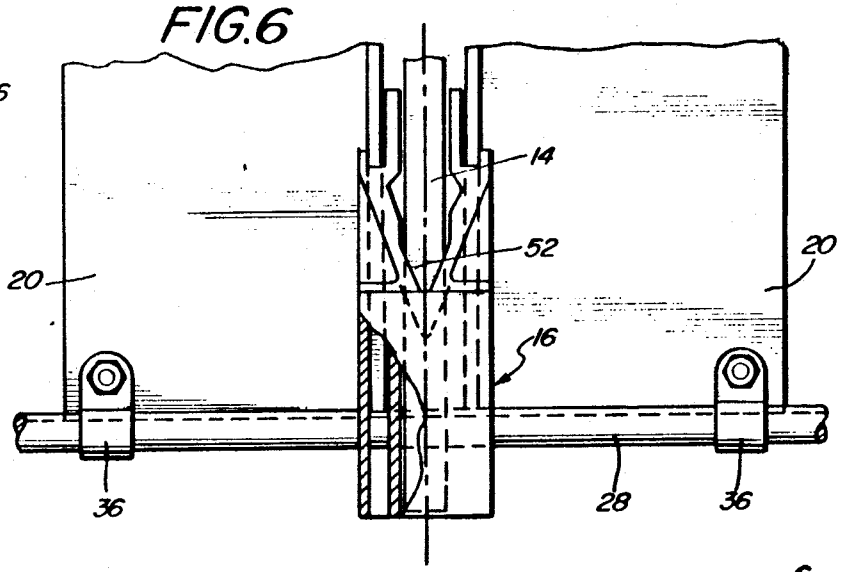
FIG. 6 is a partial top plan view of the anchor of FIG. 5 taken along line 6—6.
Figure 5:
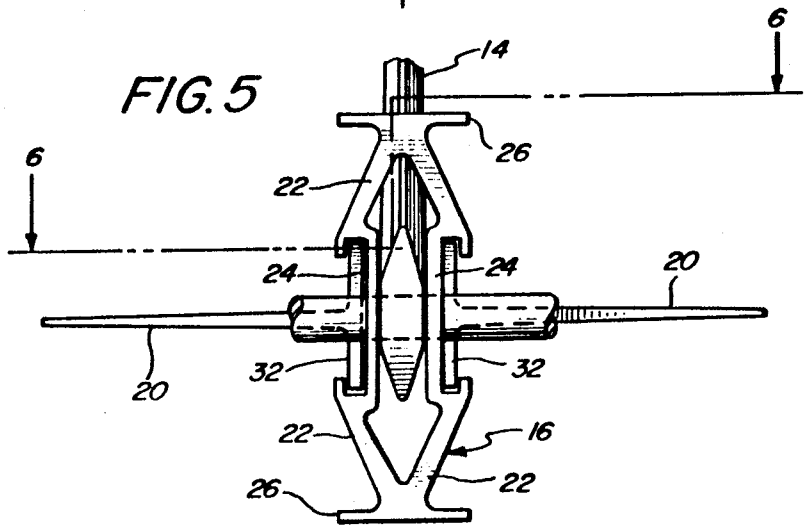
FIG. 5 is a rear plan view of the anchor of FIG. 2.
Figure 8:
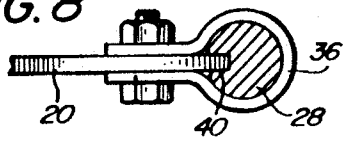
FIG. 8 is an enlarged view showing the attachment of the outer rear edge of the fluke attached to the stock taken along line 8—8 of FIG. 2.
Figure 9:
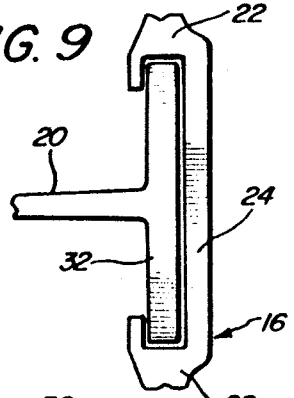
FIG. 9 is a partial front plan view of the anchor of FIG. 2 showing the crown/fluke coupling.

FIG. 2 illustrates the standard configuration of the anchor 10 with the stock inserted through the first set of side wall apertures 30. The flukes 20 engage with the crown structure 16 by inserting the T-shaped flange member 32 into the flange receiving member 24, as best seen in FIG. 9. Each flange 20 abuts against the stock 28 and thereby inserts the rear edge of the fluke 20 into the stock slot 40. The fluke 20 secures to the stock 28 by bolted C-clips 36 inserted through apertures 62, as shown in FIG. 8. As best seen in FIGS. 5 and 6, the shank 14 inserts between the crown structure side walls 22 so that the inner shank aperture 46 aligns with the crown side wall apertures 30. The stock 28 inserts through the aligned apertures 30, 46 to rotatably couple the shank 14 to the crown structure 16.

Figure 7:
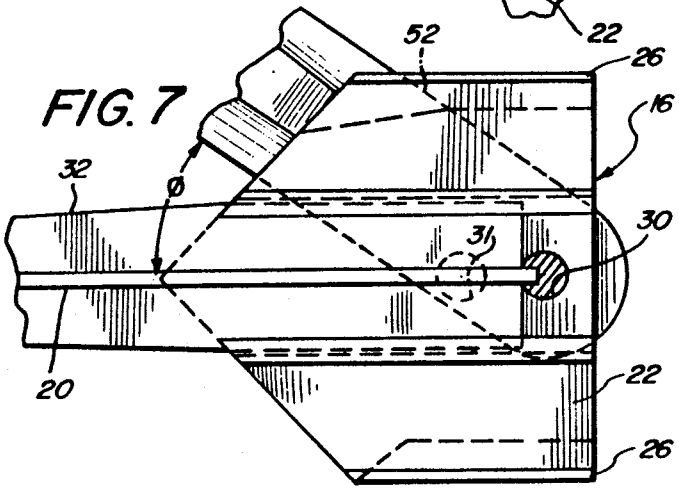
FIG. 7 is a partial side view of the anchor of FIG. 2.

As best seen in FIG. 6, the crown structure 16 includes a beveled notch 52 along the front edge portion where the tapered side walls 22 join the crown plates 26. The notch 52 is positioned so that the shank 14 may rotate to an angular position relative to the flukes 20, i.e., to form the desired shank/fluke angle $\phi$, as best seen in FIGS. 2 and 7.

Preferably, the geometric relationship between the first set of side wall apertures 30 and the notch 52 produces a shank/fluke angle $\phi$ approximately equal to about 30 to 35 degrees, and more preferably about 32 degrees. As a result, the anchor 10 assembled in the standard configuration will quickly and effectively engage the underwater bottom 12 comprised good holding ground. Additionally, the holding power of the anchor 10 is optimized at the standard shank/fluke setting when set in good holding ground.

When the underwater bottom surface condition comprises soft mud, i.e., poor holding ground, the holding power of the anchor 10 decreases when assembled in the standard configuration. By increasing the shank/fluke angle $\phi$, however, the holding power of the anchor 10 improves. Further, because of the soupy consistency of the muddy bottom surface, the anchor 10 easily engages and digs into the bottom surface 12 at the larger shank/fluke angle $\phi$.

Figure 3:
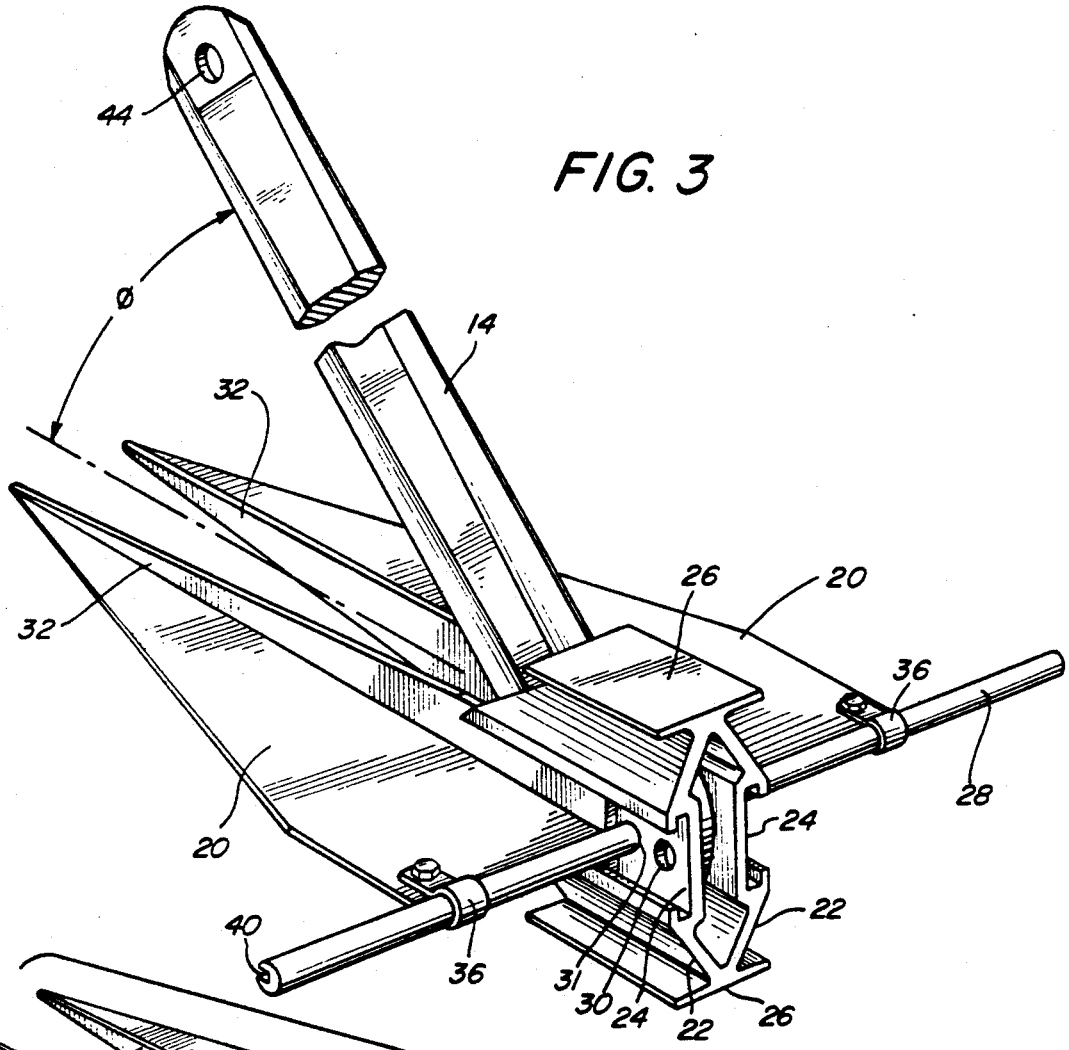
FIG. 3 is a perspective view of the optional configuration of the anchor of FIG. 1.

FIG. 3 illustrates the optional configuration of the anchor 10 with the stock inserted through the second set of side wall apertures 31. Preferably, the geometric relationship between the second set of side wall apertures 31 and the beveled notch 52 produces a shank/fluke angle $\phi$ approximately equal to about 43 to 47 degrees, and more preferably about 45 degrees. At the larger shank/fluke angle $\phi$ the holding power of the anchor 10 substantially increases. Thus, the holding power of the anchor 10 is optimized by reassembling the anchor 10 in its optional configuration for use in poor holding ground.

As shown in FIG. 4, mud palms 33 comprising generally flat plates can be attached to the crown plates 26 of the crown structure 16. When assembled, the mud palms 33 extend outward from the crown structure oblique to the crown plate surfaces 26. When setting the anchor 10, the mud palms 33 cause an aft end of the crown structure to rise in the water to help trip and set the anchor. As a result, the anchor 10 can set faster and more dependable in oily, soft mud areas. The mud palms, however, generally reduce buried depth.

Modifications and variations of the embodiment described above may be made by those skilled in the art while remaining within the true scope and spirit of this invention. For example, a pair of diametrically opposed slots, disposed in the two side walls 22, may replace the two set of apertures. A cotter pin or like means may restrain the stock 28, passing through the slots, from moving from a first position at one end of the slots to a second position at the other end of the slots, respectively corresponding to the stock position when in the first and second set of apertures 30, 31. Accordingly, the scope of the invention is intended to be only defined by the claims which follow.

What is claimed is:

1. A twin-fluke, lightweight, high performance anchor which is easily converted from an anchor for use in underwater bottom surface conditions considered to be a good holding ground, such as a sandy bottom, to an anchor for use in underwater bottom surface conditions considered to be a poor holding ground, such as a muddy bottom, so as to optimize the holding power of said anchor depending upon the firmness of the underwater bottom surface, comprising:

a crown structure having a first and second set of apertures;

a pair of flukes attached to said crown structure;

a stock removably coupled to said crown structure and selectively positioned through said first or second set of said crown structure apertures; and a shank rotatably mounted to said crown structure by engagement with said stock, said shank positioned to form a first shank/fluke angle with said stock positioned through said first set of crown structure apertures for use in underwater bottom surface conditions considered to be a good holding ground, and positioned to form a second shank/fluke angle with said stock positioned through said second set of crown structure apertures for use in underwater bottom surface conditions considered to be a poor holding ground.

2. The anchor of claim 1, wherein said second shank/fluke angle is generally larger than said first shank/fluke angle.

3. The anchor of claim 2, wherein said first shank/fluke angle approximately equals about 30 degrees.

4. The anchor of claim 2, wherein said second shank/fluke angle approximately equals about 45 degrees.

5. The anchor of claim wherein said second shank/fluke angle differs from said first shank/fluke angle by about approximately 15 degrees.

6. The anchor of claim wherein said anchor comprises an aluminum alloy.

7. The anchor of claim 6, wherein said aluminum alloy comprises 6061 T6 aluminum alloy.

8. A twin-fluke anchor for mooring a marine vessel to prevent the vessel from drifting with the wind or tide, comprising:

a crown structure;

a pair of flukes attached to said crown structure; and a shank rotatably coupled to said crown structure and positioned to form a first shank/fluke angle between said flukes, said shank adapted to be repositioned in a second position relative to said crown structure to form a second shank/fluke angle, wherein said second shank/fluke angle is greater that said first shank/fluke angle.

9. The anchor of claim 8, wherein said first shank/fluke angle approximately equals about 30 degrees.

10. The anchor of claim 8, wherein said second shank/fluke angle approximately equals about 45 degrees.

11. A method of adjusting a twin-fluke anchor configuration to optimize the holding power of the anchor depending upon whether the underwater surface comprises a good holding ground, such as a sandy bottom, or a poor holding ground, such as a soft muddy bottom, comprising the steps of:

removing a stock from a first set of apertures in a crown structure to decouple a shank from the crown structure with the shank positioned in a standard position to form a first shank/fluke angle with an effective surface of the flukes, which maximizes the holding power of the anchor used in good holding ground;

repositioning the shank in an alternative position; and inserting the stock through a second set of apertures in the crown structure and through the shank to couple the shank to the crown structure in the alternative position to form a second shank/fluke angle with the effective surface of the flukes, which maximize the holding power of the anchor used in poor holding ground.

* * * * *